United States Patent [19]

Ross

[11] 4,181,479

[45] Jan. 1, 1980

[54] BALANCED GEROTOR DEVICE WITH ECCENTRIC DRIVE

[75] Inventor: Louis Ross, Des Plaines, Ill.

[73] Assignee: Borg-Warner Corporation, Chicago, Ill.

[21] Appl. No.: 871,285

[22] Filed: Jan. 23, 1978

[51] Int. Cl.[2] ..... F01C 1/02; F01C 21/00; F01C 21/12; F03C 3/00

[52] U.S. Cl. ..... 418/61. B; 418/151

[58] Field of Search ..... 418/58, 61. R, 61. A, 418/61. B, 160, 151

[56] References Cited

U.S. PATENT DOCUMENTS

| | | | |
|---|---|---|---|
| 1,844,471 | 2/1932 | Johnson . | |
| 3,873,248 | 3/1975 | Johnson | 418/61. B |
| 3,905,727 | 9/1975 | Kilmer | 418/61. B |
| 3,909,161 | 9/1975 | Stenner | 418/61. R |
| 4,025,243 | 5/1977 | Stephens | 418/61. B |

FOREIGN PATENT DOCUMENTS

| | | | |
|---|---|---|---|
| 1553285 | 1/1970 | Fed. Rep. of Germany | 418/61. B |

*Primary Examiner*—John J. Vrablik
*Attorney, Agent, or Firm*—Julian Schachner

[57] ABSTRACT

A balanced fluid pressure device of the type including a housing in which a gerotor gear set and a shaft are supported. The gear set includes an externally toothed star gear and an internally toothed ring gear. An eccentric drive mechanism connects the ring gear with the housing so as to establish orbital movement of the ring gear. The star gear orbits within and rotates relative to the ring gear, and is connected with the shaft by another eccentric drive mechanism so as to establish rotational movement of the shaft. The mass and orbit of each gear are such that centrifugal forces developed upon orbiting thereof are substantially equal and opposite, with the result that inertial loading is substantially balanced.

25 Claims, 4 Drawing Figures

BALANCED GEROTOR DEVICE WITH ECCENTRIC DRIVE

BACKGROUND OF THE INVENTION

This invention relates generally to fluid pressure devices. More particularly, it relates to hydraulic pumps or motors of the gerotor type wherein both the ring and star gears orbit in such a manner that centrifugal forces developed by orbiting are substantially equal and opposite, with the result that the inertial loads substantially balance each other.

In recent years there have been many improvements in gerotor type pumps and motors. Some such devices incorporate a fixed ring gear within which a star gear is supported for orbital and rotational movement. A wobble shaft necessarily is associated with the star gear in order to compensate for its orbital movement. Other such devices incorporate an orbital ring gear and a rotatable star gear so as to eliminate the necessity for the wobble shaft. Devices such as these have an inherent disadvantage in that they develop dynamic loads which must be absorbed by the housing.

There remains a need for a fluid pressure device of the gerotor type wherein no dynamic loads need be absorbed by the housing, and wherein the only gear loads to be supported by an associated bearing are those related to the development of useful work. There is a further need for such a device which is susceptible of precise and economical manufacture and efficient operation, without complicated valving arrangements for controlling the porting of fluid into and out of fluid chambers between the gears. Such a device might be compatible, for example, with the valving arrangement of the type disclosed in copending U.S. application Ser. No. 839,089 filed Oct. 3, 1977. That application discloses a mechanism for efficiently controlling the flow of fluid to and from the fluid pressure device through an eccentric drive mechanism.

SUMMARY OF THE INVENTION

This invention is directed to a fluid pressure device of the gerotor type which will meet the needs noted above. The device includes a housing, an internally toothed ring gear, an externally toothed star gear, and a shaft. The housing and ring gear define an eccentric drive mechanism for establishing orbital movement of the ring gear. High and low pressure ports controlled by this eccentric drive mechanism are communicated with fluid chambers between the gears in timed relation. The star gear and shaft define another eccentric drive mechanism for establishing orbital and rotational movement of the star gear and rotational movement of the shaft. The masses of the ring and star gears and their orbits preferably are arranged such that centrifugal forces developed upon orbital movement thereof are equal and opposite, with the result that inertial loading is balanced, and no dynamic loads need be absorbed by the housing. Only the gear loads associated with useful work need be supported by an associated bearing within which the shaft rotates.

The high and low pressure ports are controlled by one of the eccentric drive mechanisms, and are communicated with the fluid chambers in timed relation through passages defined by the ring gear. This porting arrangement results in precise control of fluid flow into and out of the fluid chambers, while at the same time insuring minimal fluid losses.

Thus, the requirements of various manufacturers for balanced low speed, high torque pumps and motors of the gerotor type may be satisfied with a simplified and economical assembly, as will be described.

BRIEF DESCRIPTION OF THE DRAWING

The objects and advantages of this invention will become apparent to those skilled in the art upon careful consideration of the specification herein, including the drawing, wherein.

Figure 2:
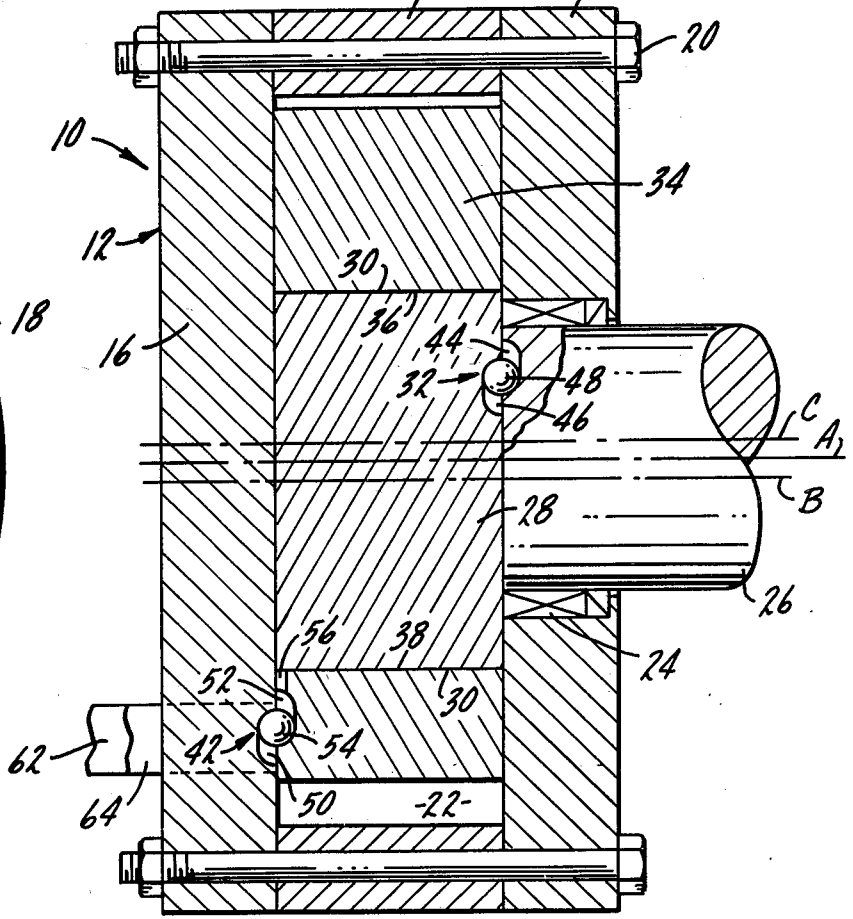
FIG. 2 is a sectional view taken along the line 2—2 of FIG. 1 showing additional details of the invention.
Figure 1:
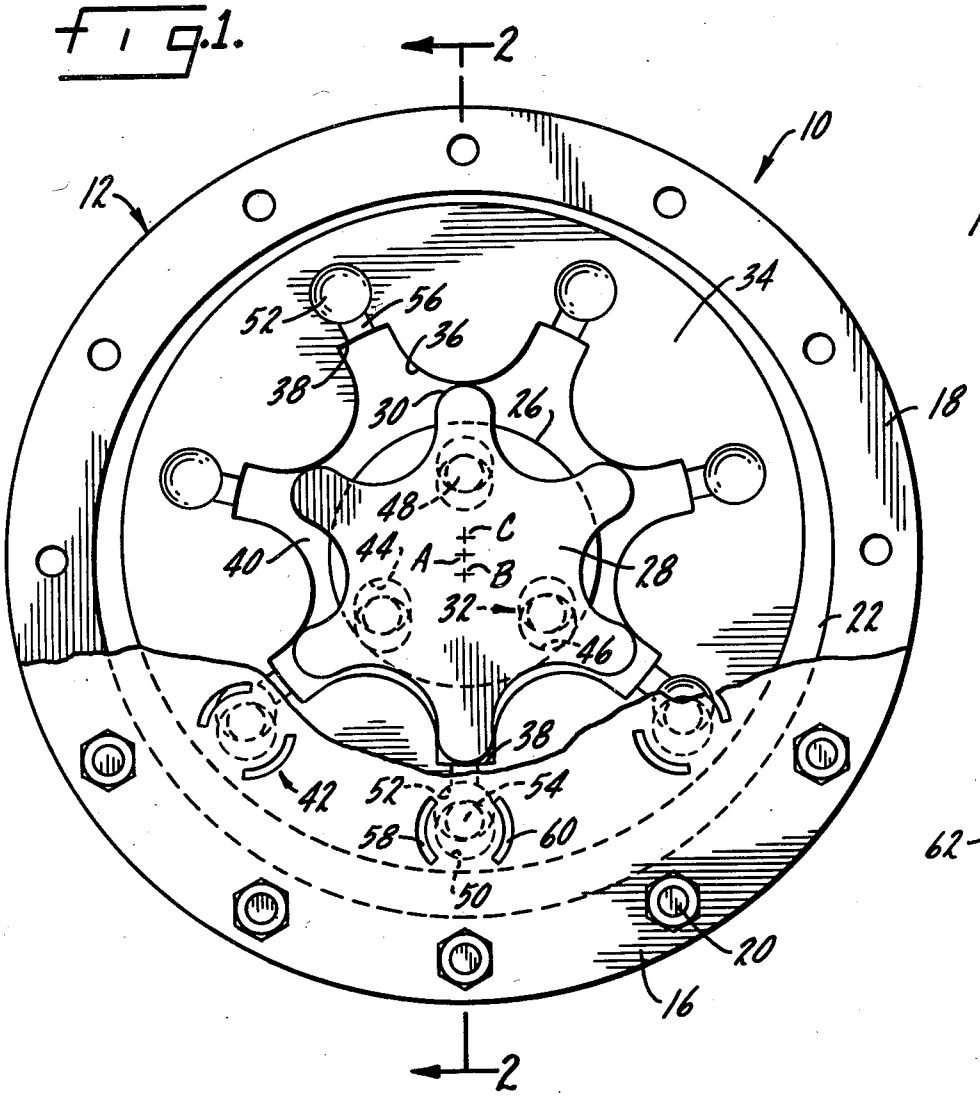
FIG. 1 is an elevational view with the housing cover removed and the ring gear partially cut away to show details of the invention.

While this invention is susceptible of embodiment in many different forms, there is shown in the drawing and herein will be described in detail a preferred embodiment. It should be understood that the present disclosure is considered to be an exemplification of the principles of the invention, and is not intended to limit the invention to this embodiment.

DESCRIPTION OF A PREFERRED EMBODIMENT

Referring now to the drawing in greater detail, there is shown a balanced fluid pressure device 10 incorporating a gerotor type pump or motor. This device 10 includes a housing 12 having a housing section 14, a housing section 16 in the form of a cover, and a housing section 18 in the form of a spacer ring. Housing sections 14, 16, and 18 are secured together by suitable bolts 20 or the like to define therewithin a suitable pump or motor cavity 22.

A bearing 24 is supported by housing section 14. A member 26 in the form of a shaft is journalled in bearing 24 for rotation on a first axis A.

Within cavity 22 is a star gear 28 having a second axis B parallel to axis A. Star gear 28 defines a plurality of external gear teeth 30. Star gear 28 is connected to shaft 26 by a plurality of first eccentric drive mechanisms 32. Also within cavity 22 is a ring gear 34 having a third axis C parallel to axes A and B. Ring gear 34 defines a plurality of internal gear teeth 36, and also defines a bottom land 38 between each pair of adjacent teeth 36. In the preferred form of the invention shown herein, star gear 28 defines six teeth 30, and ring gear 34 defines seven teeth 36. Star gear 28 and ring gear 34 together form a plurality of fluid chambers 40 which expand and contract upon meshing engagement of teeth 30 and 36. Ring gear 34 is connected to housing section 16 by a plurality of second eccentric drive mechanisms 42.

Each first eccentric drive mechanism 32 includes a plurality of first fixed bearing races 44 defined by shaft 26 and oriented concentrically about axis A. Each race 44 preferably has a semi-toroidal configuration. In a similar manner, a plurality of first orbital bearing races 46 are defined by star gear 28 and are oriented concentrically about axis B. Each race 46 also preferably takes the form of a semi-toroid. Races 44 and 46 are complimentary, and are equidistant from axes A and B, respectively. Thus, they are eccentric relative to each other by the distance between axes A and B. Mechanism 32 also includes a plurality of suitable rolling elements 48 in the form of balls or the like supported in rolling contact with races 44 and 46. Mechanism 32 is constructed such that as balls 48 roll around races 44 and 46, star gear 28 orbits such that axis B defines a circle about axis A.

Each second eccentric drive mechanism 42 includes a plurality of second fixed bearing races 50 defined by housing section 16 and oriented concentrically about axis A. Each race 50 preferably has a semi-toroidal configuration. In a similar manner, a plurality of second orbital bearing races 52 are defined by ring gear 34 and are oriented concentrically about axis C. Each race 52 also preferably takes the form of a semi-toroid. Races 50 and 52 are complimentary, and are equidistant from axes A and C, respectively, Thus, they are eccentric relative to each other by the distance between axes A and C. Mechanism 42 also includes a plurality of suitable rolling elements 54 in the form of balls or the like supported in rolling contact with races 50 and 52. Mechanism 42 is constructed such that as balls 54 roll around races 50 and 52, ring gear 34 orbits such that axis C defines a circle about axis A.

Figure 4:
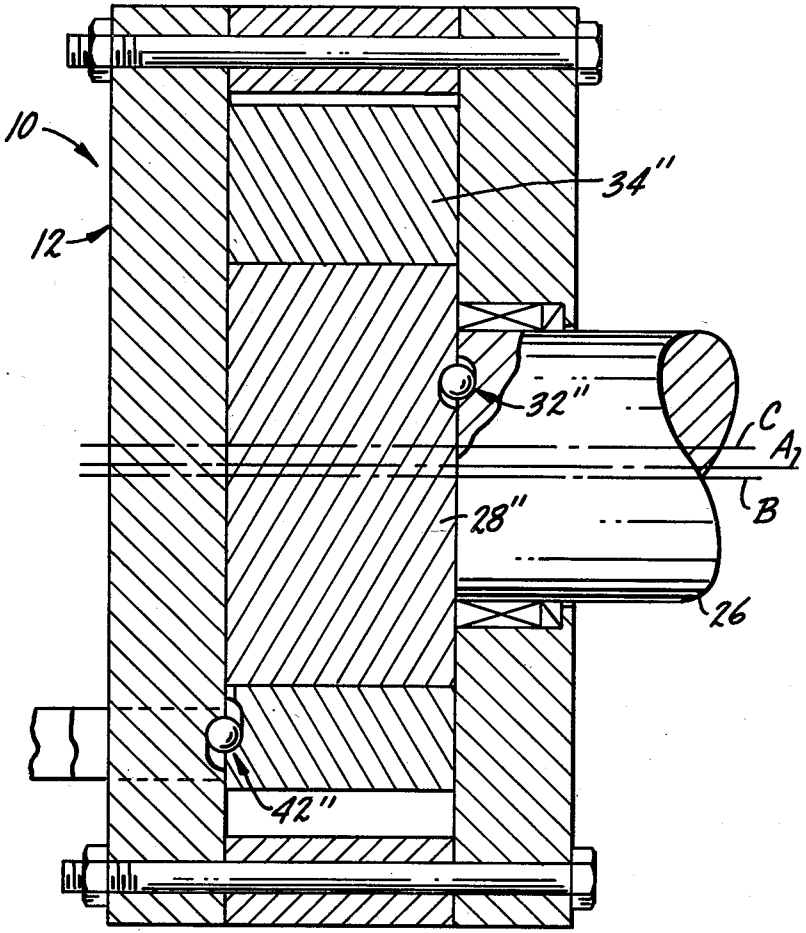
FIG. 4 is a sectional view similar to FIG. 2 showing another modification of the invention.
Figure 3:
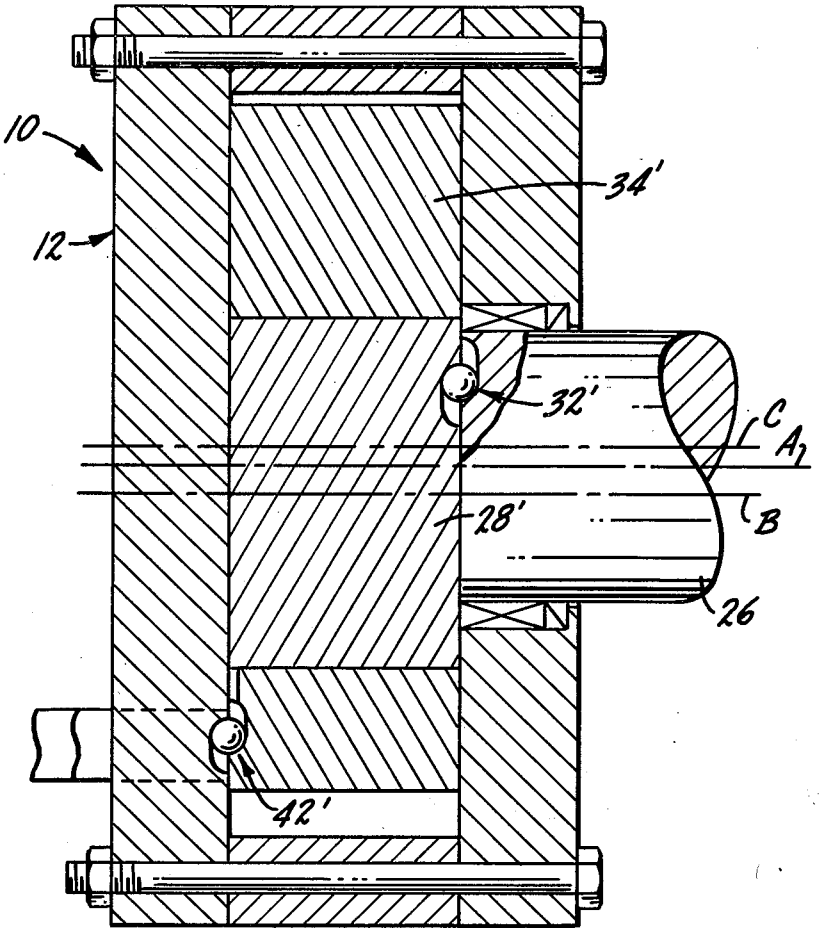
FIG. 3 is a sectional view similar to FIG. 2 showing a modification of the invention.

The respective masses of gears 28 and 34 and the respective orbits determined by mechanisms 32 amd 42 preferably are such that the centrifugal forces generated as gears 28 and 34 orbit are equal and opposite. For example, as shown in FIG. 2, if the masses of gears 28 and 34 are equal, mechanisms 32 and 42 would be constructed such that the oribts of gears 28 and 34 are equal. As shown in FIG. 3, if the mass of star gear 28' is less than that of ring gear 34', mechanisms 32' and 42' would be constructed such that the orbit of star gear 28' is greater than that of ring gear 34'. As shown in FIG. 4, if the mass of star gear 28" is greater than that of ring gear 34", mechanisms 32" and 42" would be constructed such that the orbit of star gear 28" is less tha that of ring gear 34". The important point is that centrifugal forces generated as gears 28 and 34 orbit are substantially equal and opposite. As the orbital radii of gears 28 and 34 are less than those of prior art devices, clearance requirements are reduced, and design is made easier. Moreover, by reducing orbital magnitudes, vibrations resulting from dynamic forces are attenuated, or indeed may be eliminated.

As disclosed in detail in the aforementioned U.S. application Ser No. 839,089, each race 52 is on a radius extending from axis C through an adjacent bottom land 38 of ring gear 34. A plurality of fluid passages 56 are defined by ring gear 34. Each passage 56 communicates a chamber 40 with its adjacent race 52.

Associated with each fixed race 50 are a pair of high and low pressure ports 58 and 60, respectively. These ports 58 and 60 are defined by housing section 16 and preferably are kidney-shaped, having inner and outer surfaces concentric with their associated fixed races 50. In the preferred form of the invention shown herein, the outer edges of races 52 coincide with the outer surfaces of ports 58 and 60 as ring gear 34 oribts.

A suitable high pressure inlet 62 communicates through housing section 16 with each high pressure port 58. Similarly, a suitable low pressure outlet 64 communicates through housing section 16 with each low pressure port 60.

Assuming that fluid pressure device 10 is operated as a low speed, high torque motor, fluid is directed through high pressure inlet 62 to high pressure ports 58. Porting is controlled by mechanisms 42, and fluid is directed from ports 58 sequentially through their associated mechanisms 42 and some passages 56 into some chambers 40. At the same time, fluid is directed from other chambers 40 through other passages 56 and, under the control of associated mechanisms 42, sequentially to low pressure ports 60 and low pressure outlet 64.

Ring gear 34 orbits about axis A but does not rotate. As ring gear 34 orbits, mechanisms 42 act as valves to time fluid flow from high pressure ports 58 sequentially into chambers 40, and from chambers 40 sequentially to low pressure ports 60. This causes star gear 28 to orbit about axis A. Star gear 28 also rotates at a low speed with a resulting torque multiplication determined by the number of teeth 30 vis-a-vis teeth 36. Mechanisms 32 establish pure rotational movement of shaft 26 on axis A.

Device 10 could be operated as a pump by rotating shaft 26. Star gear 28 would rotate and orbit, and ring gear 34 would orbit. Fluid would be drawn in through inlet 62 and forced out through outlet 64.

A couple tending to cause twisting may result from the fact that mechanisms 32 and 42 are not in the same plane. This may be compensated for by locating mechanisms 42 between ring gear 34 and housing section 14, or by extending shaft 26 through star gear 28, journalling it in a bearing supported by housing section 16, and locating mechanisms 32 in line with mechanisms 42. Further, if balls 48 and 54 are required to support very high torque loads, mechanisms 32 and 42 could be located on both sides of gears 28 and 34.

Thus, it will be seen that a balanced fluid pressure device of the gerotor type has been provided wherein the ring gear orbits, the star gear orbits and rotates, and the shaft rotates. Fluid flow is controlled by one of two eccentric drive mechanisms. Centrifugal forces developed as a result of orbital movement of the gears are substantially equal and opposite, and thus dynamic loading approaches zero. Only those gear loads associated with the development of useful work need be supported by the bearing. While a preferred embodiment of the invention has been shown and described, this should be considered as illustrative and may be modified by those skilled in the art. It is intended that the claims herein cover all such modifications as may fall within the spirit and scope of the invention.

What is claimed is:

1. A fluid pressure device comprising a housing, first and second members in said housing for cooperatively defining expanding and contracting fluid chambers, an element supported by said housing for rotation on an axis fixed with respect thereto, first means in said housing establishing an orbital path for said first member about said axis, said first means restraining rotational movement of said first member, and second means in said housing establishing an orbital path for said second member about said axis, said second means permitting rotational movement of said second member and rotation of said element on said axis.

2. The invention of claim 1, said first means being first eccentric drive means connecting said first member with said housing, and said second means being second eccentric drive means connecting said second member with said element, said eccentric drive means establishing orbital paths such that movement of said members in their respective orbits is approximately 180° out of phase.

3. The invention of claim 2, said members having masses and said eccentric drive means establishing orbital paths such that the net dynamic load resulting from orbital movement of said members is approximately zero.

4. The invention of claim 3, the masses of said members being approximately equal, and the orbits of said members being approximately equal and opposite, whereby the net dynamic load resulting from orbital movement of said members is approximately zero.

5. The invention of claim 3, the mass of said first member being greater than the mass of said second member, and the orbit of said first member being smaller than the orbit of said second member, whereby the net dynamic load resulting from orbital movement of said members is approximately zero.

6. The invention of claim 3, the mass of said second member being greater than the mass of said first member, and the orbit of said second member being smaller than the orbit of said first member, whereby the net dynamic load resulting from orbital movement of said members is approximately zero.

7. In a fluid pressure device including a housing, a member supported by said housing for rotation on an axis fixed with respect thereto, an internally toothed ring gear in said housing, an externally toothed star gear in said housing, said ring and star gear teeth being engageable to define expanding and contracting fluid chambers therebetween, and means for porting fluid to and from said chambers; the improvement comprising first means in said housing establishing orbital movement of one of said gears about said axis, said first means restraining rotational movement of said one gear, and second means in said housing establishing orbital movement of the other of said gears about said axis, said second means also establishing rotation of said member on said axis.

8. The invention of claim 7, said one gear being said ring gear, said other gear being said star gear, said first means being first eccentric drive means connecting said ring gear with said housing, and said second means being second eccentric drive means connecting said star gear with said member.

9. The invention of claim 8, said gears and eccentric drive means being constructed and arranged such that centrifugal force developed upon orbital movement of said ring gear is substantially equal and opposite to centrifugal force developed upon orbital movement of said star gear.

10. The invention of claim 9, the mass of said ring gear being substantially equal to the mass of said star gear, and the orbit of said ring gear about said axis being substantially equal to the orbit of said star gear about said axis.

11. The invention of claim 9, the mass of said ring gear being greater than the mass of said star gear, and the orbit of said ring gear about said axis being smaller than the orbit of said star gear about said axis.

12. The invention of claim 9, the mass of said star gear being greater than the mass of said ring gear, and the orbit of said star gear about said axis being smaller than the orbit of said ring gear about said axis.

13. The invention of claim 8, said fluid porting means incorporating one of said eccentric drive means.

14. The invention of claim 13, said one eccentric drive means being said first eccentric drive means.

15. The invention of claim 14, said first eccentric drive means including a plurality of fixed races defined by said housing, a plurality of orbital races defined by said ring gear and spaced from said fixed races, and a plurality of rolling elements, each rolling element being in rolling contact with a fixed and an orbital race, a plurality of passages defined by said ring gear, each passage communicating an orbital race with a fluid chamber, and a plurality of fluid ports defined by said housing and spaced from each fixed race, each orbital race communicating sequentially with said fluid ports as said ring gear orbits, thereby effecting said fluid porting.

16. A gerotor device comprising a housing defining fluid inlet and outlet means, a shaft journalled for rotation in said housing on a first axis, a gerotor gear set in said housing, said gear set including a star gear having a second axis and a ring gear having a third axis, said housing and one of said gears defining first eccentric drive means establishing orbital movement of said one gear about said first axis, said shaft and the other of said gears defining second eccentric drive means establishing orbital movement of said other gear about said first axis and rotation of said shaft on said first axis, and means for controlling timed fluid communication between said fluid inlet means and fluid chambers defined by said gears, said controlling means also controlling timed fluid communication between said fluid chambers and said fluid outlet means.

17. The invention of claim 16, said one gear being said ring gear, and said other gear being said star gear.

18. The invention of claim 16, said gears having masses and said eccentric drive means establishing orbital movements such that dynamic loads developed as a result of orbital movement of said gears are substantially balanced.

19. The invention of claim 18, said one gear being said ring gear, and said other gear being said star gear.

20. The invention of claim 16, said gears and eccentric drive means being constructed and arranged such that centrifugal force developed by said one gear as it orbits is substantially equal and opposite to centrifugal force developed by said other gear as it orbits.

21. The invention of claim 20, said one gear being said ring gear, and said other gear being said star gear.

22. The invention of claim 11, said axes being parallel.

23. The invention of claim 22, the mass of said one gear being substantially equal to the mass of said other gear, said first eccentric drive means being constructed and arranged such that said one gear orbits about said first axis in a circle having a radius substantially equal to the distance between said first axis and the axis of said one gear, and said second eccentric drive means being constructed and arranged such that said other gear orbits about said first axis in a circle having a radius substantially equal to the distance between said first axis and the axis of said other gear.

24. The invention of claim 23, said controlling means incorporating said first eccentric drive means and fluid passage means defined by said one gear and communicating said first eccentric drive means with said fluid chambers, said first eccentric drive means defining valve means controlling timed fluid communication between said fluid inlet means and said fluid passage means and between said fluid passage means and said fluid outlet means as said one gear orbits.

25. The invention of claim 24, said one gear being said ring gear, and said other gear being said star gear.

* * * * *